US008104492B2

(12) United States Patent
Dan

(10) Patent No.: US 8,104,492 B2
(45) Date of Patent: Jan. 31, 2012

(54) ADJUSTABLE OFFSET UMBRELLA

(75) Inventor: Wu Wei Dan, San Men (CN)

(73) Assignee: Southern Sales & Marketing Group, Inc., Atlanta, GA (US)

( * ) Notice: Subject to any disclaimer, the term of this patent is extended or adjusted under 35 U.S.C. 154(b) by 0 days.

(21) Appl. No.: 12/435,640

(22) Filed: May 5, 2009

(65) Prior Publication Data

US 2010/0051074 A1 Mar. 4, 2010

Related U.S. Application Data

(60) Provisional application No. 61/050,353, filed on May 5, 2008.

(51) Int. Cl.
*A45B 17/00* (2006.01)

(52) U.S. Cl. ..... 135/20.3; 135/21

(58) Field of Classification Search ..... 135/20.1, 135/20.3

See application file for complete search history.

(56) References Cited

U.S. PATENT DOCUMENTS 5,284,171 A * 2/1994 Liu ..... 135/20.3
5,937,882 A * 8/1999 Harbaugh ..... 135/20.3
5,960,806 A * 10/1999 Steiner ..... 135/20.1
6,478,037 B2 * 11/2002 Tung ..... 135/21
6,923,193 B2 * 8/2005 Chen ..... 135/20.1
6,945,263 B2 * 9/2005 Li et al. ..... 135/20.1
7,156,114 B2 * 1/2007 Lo ..... 135/21
7,886,755 B2 * 2/2011 Tung ..... 135/21
2002/0121297 A1 * 9/2002 Li et al. ..... 135/20.1
2002/0129847 A1 * 9/2002 Ma ..... 135/98
2005/0028852 A1 * 2/2005 Reese ..... 135/20.1
2006/0254628 A1 * 11/2006 Tseng ..... 135/20.1

* cited by examiner

*Primary Examiner* — Noah Chandler Hawk

(74) *Attorney, Agent, or Firm* — Kilpatrick Townsend & Stockton LLP

(57) ABSTRACT

An adjustable offset umbrella has a generally vertical main pole and a sliding member slidably mounted to the main pole. The sliding member includes a locking mechanism for securing it at a desired location along the main pole. One end of an arm is associated with the sliding member, and the other end supports an umbrella canopy. A winding mechanism is associated with the sliding member and moves with it. A line extends from the winding mechanism to the umbrella canopy. Operating the winding mechanism opens and closes the umbrella canopy, and moving the sliding member up or down the main pole adjusts the angle of the canopy with respect to the main pole.

7 Claims, 5 Drawing Sheets

ADJUSTABLE OFFSET UMBRELLA

CROSS-REFERENCE TO RELATED APPLICATIONS

The present application claims priority of provisional application Ser. No. 61/050,353, filed May 5, 2008.

TECHNICAL FIELD

The present invention relates generally to umbrellas used as shade from the sun and relates more specifically to an offset umbrella with an improved mechanism for raising and lowering the umbrella canopy and for adjusting the angle of the canopy with respect to a vertical support member.

BACKGROUND OF THE INVENTION

As an outdoor leisure product, sunshade umbrellas are widely used in squares, parks, on the beaches, patio and other leisure places, offering comfortable shade to shield people from the sun.

Conventional umbrellas generally have a main pole extending from the center of the umbrella downward to a support surface. An improvement on this design is the offset umbrella, shown for example in U.S. Pat. No. 5,937,882. The main pole of an offset umbrella utilizes a cantilever arrangement to suspend the canopy to the side of the main pole such that the main pole does not occupy space in the shady area beneath the canopy. For additional convenience, the angle of the canopy can be adjusted with respect to the main pole.

Existing adjustable offset umbrellas such as that disclosed in the previously mentioned U.S. Pat. No. 5,937,882 utilize a crank mechanism both for raising and lowering the canopy and for adjusting the angle of the canopy. The crank mechanism is mounted to the main pole, and the rope moves along a complex path with many turning points. This arrangement requires more winding force, and the rope can easy bind and wear, adversely affecting the umbrella's operation. These disadvantages make the operation of the umbrella burdensome and decrease the enjoyment of leisure time.

SUMMARY OF THE INVENTION

Stated generally, the umbrella of the present invention comprises a main pole having a lower end for support by a support surface and extending generally upward to an upper end. A sliding member is associated with the main pole and is selectably moveable thereon between lower and upper locations along the main pole. The sliding member includes a locking means for releasably securing the sliding member to the main pole at a desired location.

The umbrella has a canopy having a central region. An arm extends radially from the central region of the canopy to an outer end operatively associated with the sliding member. A brace is associated with the arm at a location thereon between the central region of the umbrella canopy and the outer end of the arm, the brace extending to the main pole at a location in spaced relation to the sliding member. A winding element is mounted to the sliding member and is movable therewith. A line extends along the arm from the winding element to engage the umbrella canopy. Operation of the winding element applies tension to the line to open or close the umbrella canopy in response to movement of the line. The angle of the umbrella canopy with respect to the main pole can be controlled by moving the sliding member along the main pole.

Thus it is an object of the present invention to provide an improved offset umbrella.

It is another object of the present invention to provide an offset umbrella that simplifies the path of the line from the winding mechanism to the umbrella canopy so as to reduce the force needed to operate the winding mechanism and to reduce wear and binding of the line.

It is still a further object of the present invention to provide an offset umbrella that separates the function of raising and lowering the canopy from the function of adjusting the angle of the canopy so as to reduce the amount of effort required for each of these functions.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
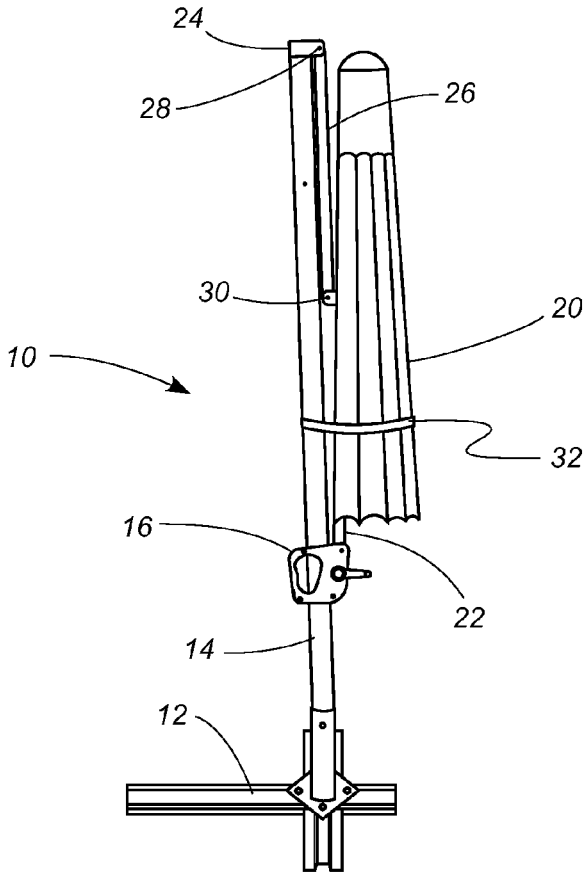
FIG. 1 is a perspective view of an adjustable offset umbrella with the umbrella canopy lowered.
Figure 2:
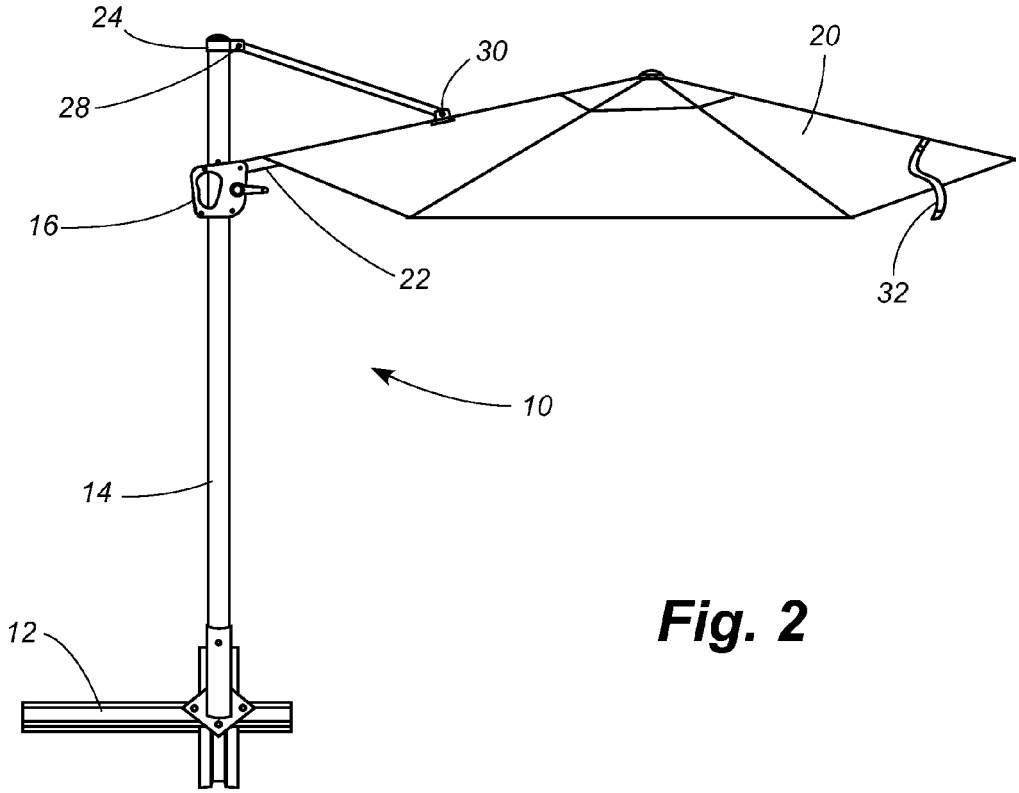
FIG. 2 is a perspective view of the adjustable offset umbrella of FIG. 1 with the canopy raised.

Referring now to the drawings, in which like numerals indicate like elements throughout the several views, FIGS. 1 and 2 illustrate an adjustable offset umbrella 10. The adjustable offset umbrella 10 includes a base 12 that supports a main pole 14 in a generally vertical orientation. A sliding member 16 is movably mounted to the main pole 14 for sliding movement between upper and lower positions along the pole. In the disclosed embodiment, the sliding member 16 takes the form of a collar that extends around the main pole 14. However, it will be understood that alternate mounting arrangements for slidably mounting the sliding member 16 to the main pole 14 may be employed without the requirement that the sliding member 16 completely encircle the main pole 14.

A canopy assembly 20 is supported alongside the main pole 14 by a main support arm 22. The main support arm 22 is pivotally mounted to the sliding member 16 at one end and extends to the central portion of the canopy assembly 20.

A cap 24 is mounted to top to main pole 14. A brace 26 has a first end pivotally mounted to the cap 24 at a first pivot point 28. The opposite end of the brace 26 is mounted to the main support arm 22 at a second pivot point 30. A strap 32 mounted to the canopy assembly 20 wraps around the main pole 14 when the umbrella is in its lowered position to prevent the canopy from blowing open in the wind.

Figure 3:
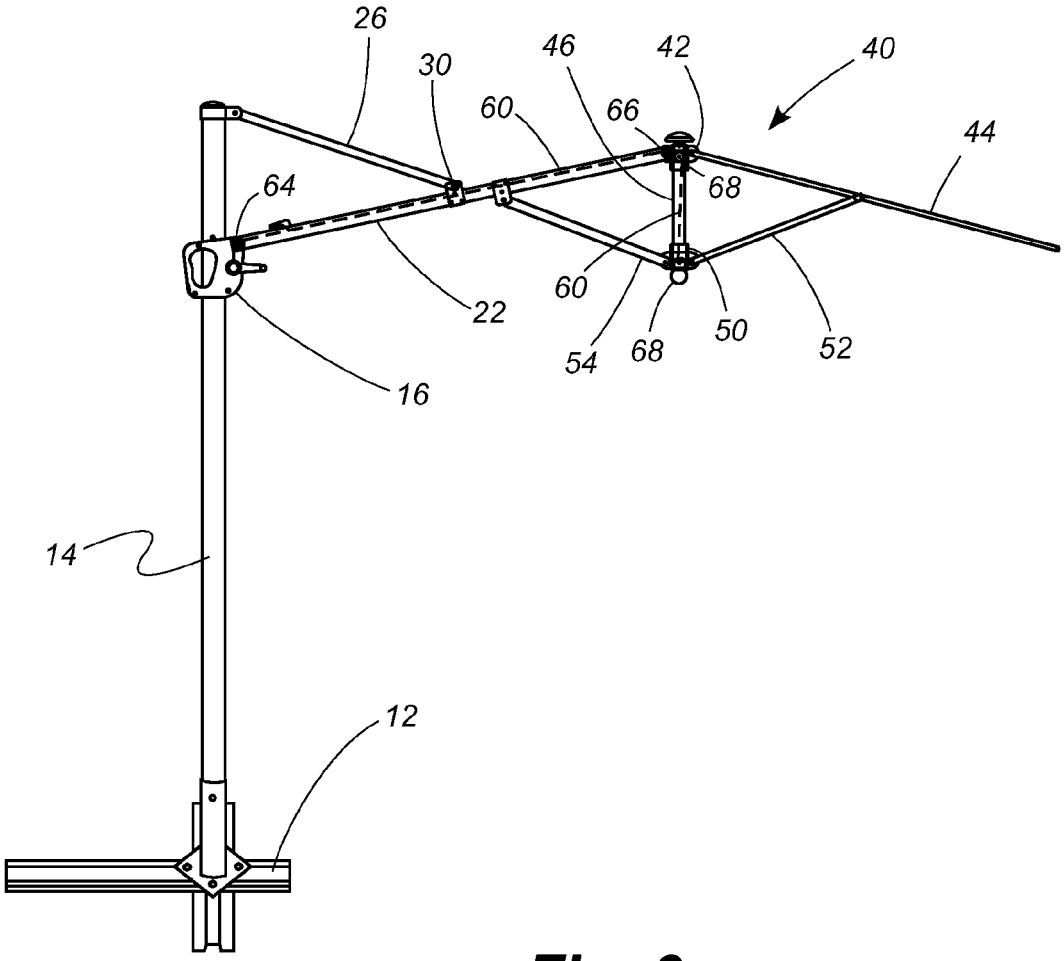
FIG. 3 is a schematic representation of the adjustable offset umbrella of FIG. 2 with the canopy removed to reveal the underlying rib structure.

Referring now to FIG. 3, the canopy fabric is removed to reveal a canopy support structure 40. The canopy support structure 40 include a rib hub 42. A plurality of radially extending canopy support ribs 44 are pivotally mounted to the rib hub 42. The main support arm 22 serves as a support rib and is also pivotally mounted to the rib hub 42.

A canopy support post 46 extends downward from the rib hub 42. A spreader hub 50 is slidably engaged with the lower end of the canopy support post 46. A spreader 52 is associated with each rib 44 and is pivotally attached to the rib 44 at its upper end and to the spreader hub 50 at its lower end. In the disclosed embodiment, a spreader 54 attached to the main support arm 22 is of more robust construction than the other spreaders 52 because of the additional weight that it must support. However, it will be appreciated that all of the spreaders 52, 54 can be of identical design for ease of manufacture and assembly.

A line 60 (shown in dashed lines in FIG. 3) extends inside the main support arm 22 from the lower end of the support arm to its upper end. The line 60 then extends downward inside the canopy support post 46 to a ball 62. To reduce friction and abrasion on the line 60, the line passes over a first pulley 64 at the lower end of the main support arm 22, over a second pulley 66 at the upper end of the main support arm, and over a third pulley 68 in the upper end of the canopy support post 46.

Figure 4:
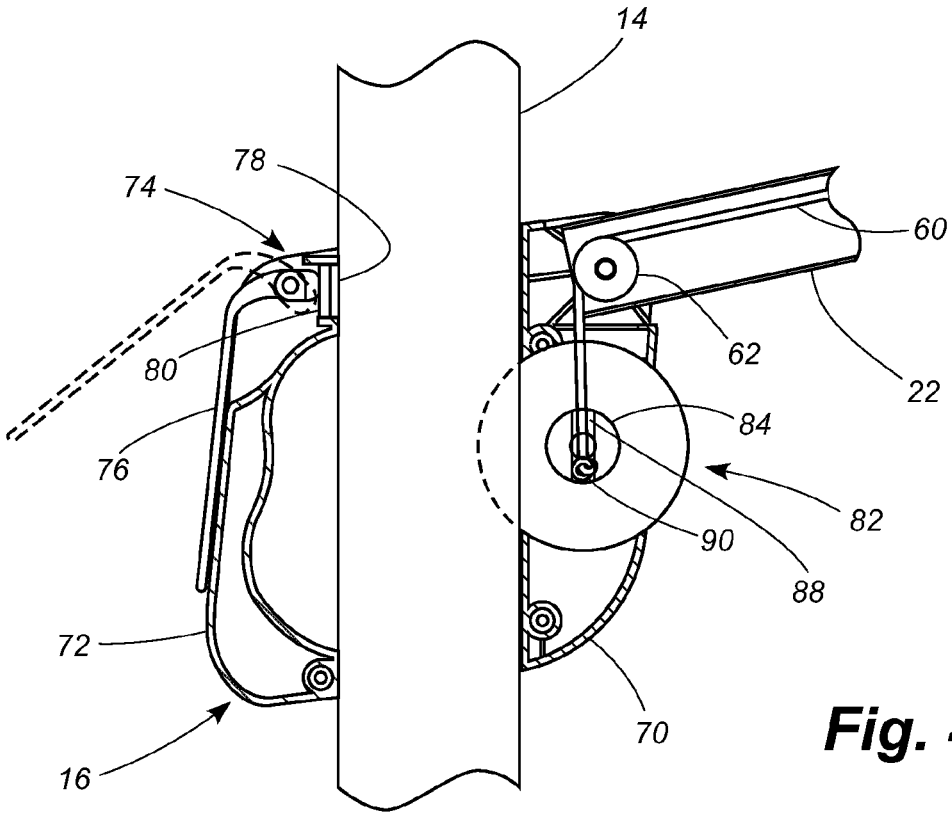
FIG. 4 is a side cutaway view of a sliding member of the adjustable offset umbrella of FIGS. 1 and 2.

Referring now to FIG. 4, the sliding member 16 includes a housing 70, the rear portion 72 of which is formed in the shape of a handle that may be easily grasped by a user. A cam lock member 74 is pivotally mounted in an upper portion of the housing 70. The cam lock member 74 comprises a lever portion 76 and a cam surface 78. When viewed from the end, the lever portion 76 is slightly narrower than the housing 70. When the cam lock member 74 is in its "down" or "stored" position, the cam surface 78 bears against a spring loaded button 80, which in turn clamps against the main pole 14 to secure the sliding member 16 against the pole. When the lever portion 76 of the cam lock member 74 is in its up position, shown in the dashed line, the cam surface 78 is rotated free of the button 80. The spring then causes the button 80 to retract, and the sliding member 16 can move freely up and down the main pole 14.

Figure 5:
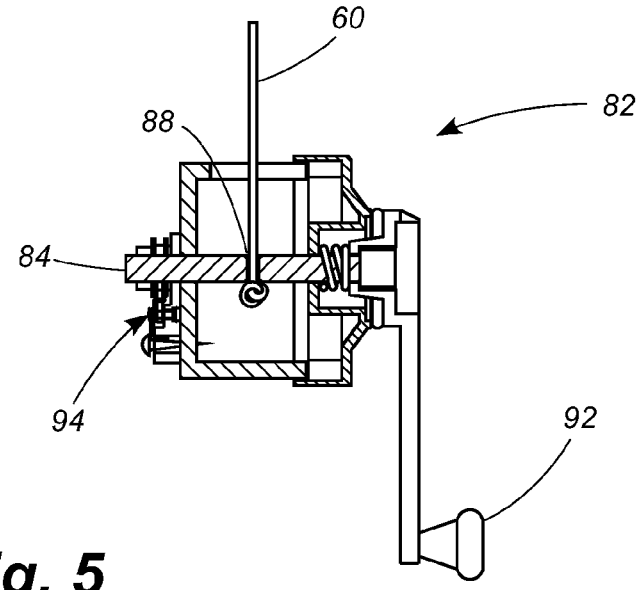
FIG. 5 is an end cutaway view of a winding mechanism that is associated with the collar of FIG. 4.

A winding mechanism 82 is also mounted to the housing 70 of the sliding member 16. With reference to FIGS. 4 and 5, the winding mechanism 82 includes a winder hub 84 around which the line 60 can be wrapped. The end of the line 60 extends through a hole 88 and is knotted or otherwise secured to prevent the line from passing back through the hole 88. As can be seen in FIG. 5, a crank 92 is provided by which a user can rotate the winding mechanism 82 to tension or to relax the line 60. A latch mechanism 94 permits the user to lock the winding mechanism 82 in place once the line 60 has been retracted or extended to the desired extent.

Figure 6:
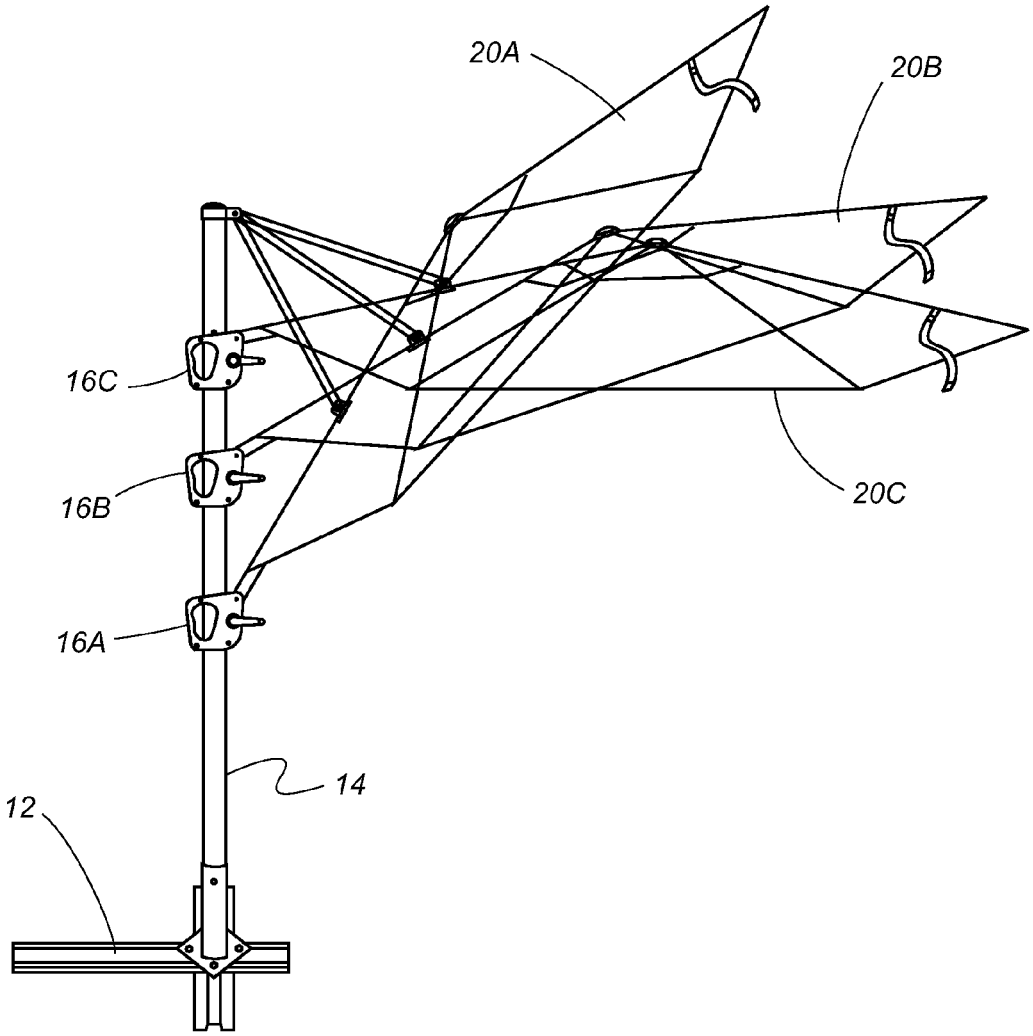
FIG. 6 is a side perspective view of the adjustable offset umbrella of FIGS. 1 and 2 showing the canopy supported at various angles with respect to the vertical support.

Referring now to FIG. 6, movement of the sliding member 16 up and down the main pole 14 adjusts the angle of the canopy assembly 20 with respect to the main pole 14 as shown. The position of sliding member 16A corresponds to the position of the canopy assembly 20A, the position of the sliding member 16B corresponds to the position of the canopy assembly 20B, and the position of the sliding member 16C results in the position of the canopy assembly 20C.

To erect the umbrella canopy assembly 20 of the umbrella 10, the user first grasps the crank 92 of the winding mechanism 82 and winds in the line 60. Tension on the line 60 draws the ball 62 at the opposite end of the line upward, elevating the spreader hub 50. As the spreader hub 50 is raised, the canopy assembly 20 extends.

Once the canopy assembly 20 has been fully erected, the user can adjust the angle of the canopy assembly with respect to the main pole 14 by moving the sliding member 16 up or down the pole until the desired result is achieved. To move the sliding member 16, the user first rotates the cam lock member 74 to its extended position. This movement disengages the cam surface 78 from the spring loaded button 80 and unclamps the sliding member 16 from the main pole 14. The user then moves the sliding member 16 up or down the main pole 14 until the canopy assembly 20 is at the desired angle. Once the desired angle has been achieved, the user rotates the cam lock member 74 back to its retracted position, clamping the sliding member 16 securely against the main pole 14.

Figure 7:
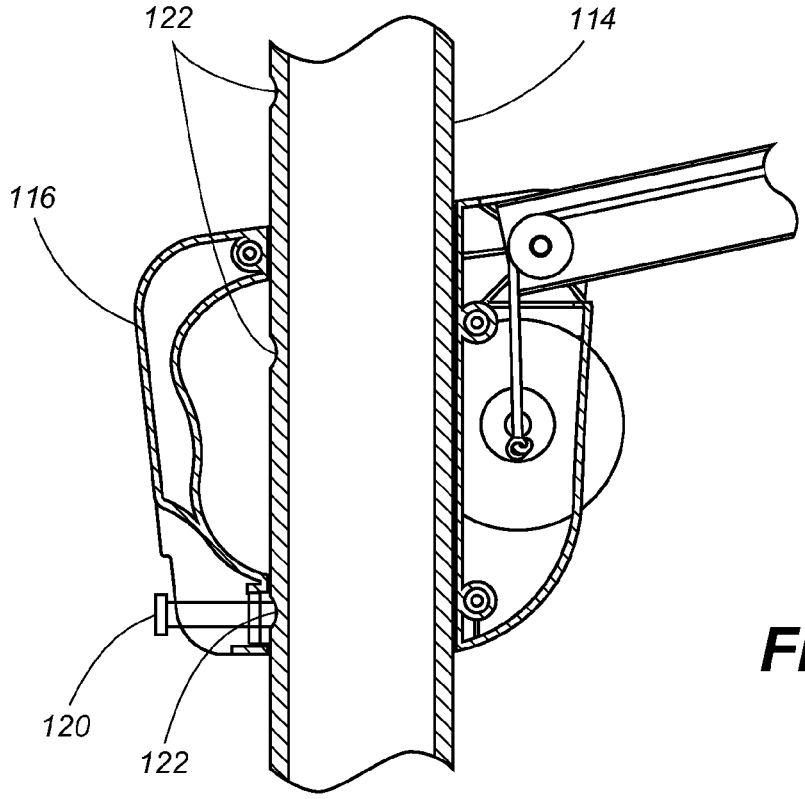
FIG. 7 is a first alternate embodiment of a sliding member.

FIG. 7 illustrates an alternate embodiment of a sliding member 116. This embodiment employs a spring-loaded latch pin 120 mounted to the sliding member 116 that engages one of a corresponding series of holes 122 in the main pole 114. To move the sliding member 116 from one location on the main pole 114 to another, the user extracts the latch pin 120 until it disengages the hole, slides the sliding number upward or downward to a desired new location, and engages the latch pin with a new one of the series of holes 122.

Figure 8:
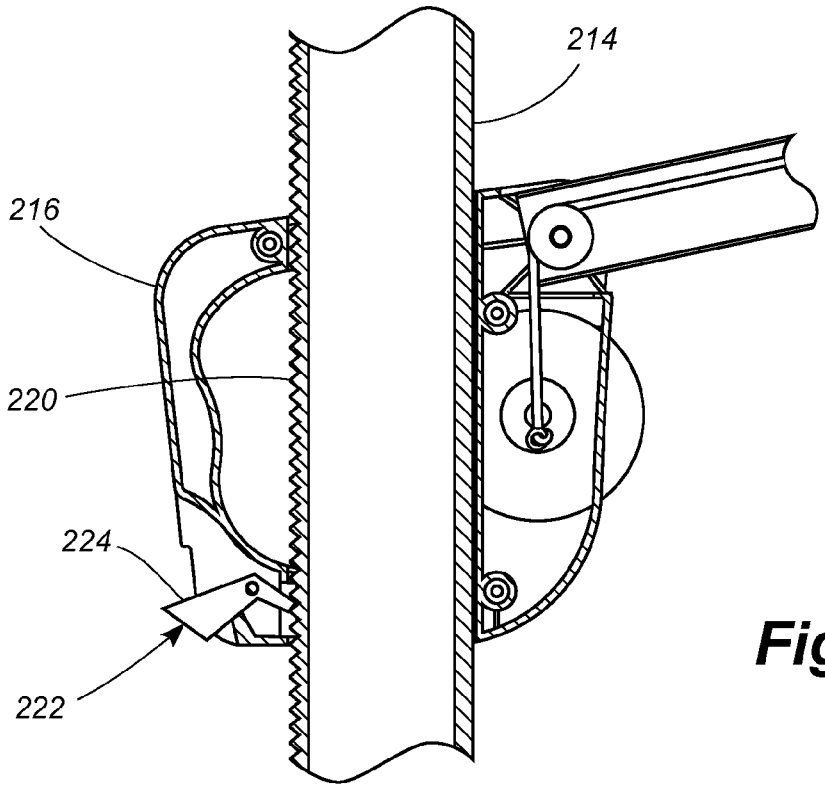
FIG. 8 is a second alternate embodiment of a sliding member.

FIG. 8 illustrates another embodiment of a sliding member 216 in which a plurality of ratchet teeth 220 are formed along the rear surface of the main pole 214. A pawl 222 pivotally mounted to the sliding mechanism 216 engages a cooperating one of the ratchet teeth 220 to lock the sliding member 216 in position. To move the sliding member 216 from one location on the main pole 214 to another, the user raises a lever portion 224 on the pawl 222 to disengage the pawl from the ratchet teeth 220, moves the sliding member 216 to a new desired location, and releases the spring-loaded pawl to re-engage the ratchet teeth.

In the foregoing embodiments, the main pole is described as being rectangular in shape. However, the main pole is not limited to a rectangular cross-section but can be round, oval, or any other of a number of suitable shapes.

In the embodiment of FIGS. 1-6 the handle of the lever is described as being pivoted at its upper end. However, it will be appreciated that the latch mechanism 74 can be mounted at the lower end of the slide 16, with the handle 76 being pivoted at its lower end.

Finally, it will be understood that the foregoing embodiments have been disclosed by way of example and that other modifications may occur to those skilled in the art without departing from the scope and spirit of the appended claims.

What is claimed is:

1. An umbrella comprising:

a main pole having a lower end for support by a support surface and extending generally upward to an upper end;

a sliding member associated with the main pole and selectably moveable thereon between lower and upper locations along the main pole;

locking means for releasably securing the sliding member to the main pole at a selected location along the main pole;

an umbrella canopy having a central region;

an arm associated with the central region and extending radially therefrom to an outer end operatively associated with the sliding member;

a brace having a first end pivotably attached to an upper portion of the pole above the sliding member and a second end pivotably attached to the arm;

a winding mechanism having a winder hub around which a line can be wound, the winder hub being mounted to the sliding member and movable therewith;

a line having a first end that winds around the winder hub, an intermediate portion extending from the winder hub along the arm to the umbrella canopy, and a second end that engages the umbrella canopy;

wherein rotation of the winder hub tensions or relaxes the line depending upon the direction of rotation of the winder hub, and wherein operation of the winding mechanism to apply tension to the line opens and closes the umbrella canopy in response to movement of the line; and wherein the angle of the umbrella canopy with respect to the main pole can be controlled by moving the sliding member along the main pole.

2. The umbrella of claim 1, wherein the locking means for releasably securing the sliding member to the main pole comprises a cam latch member having a cam surface, the cam latch member being rotatable with respect to the sliding member between a first position in which the cam surface causes the sliding member to be clamped against the main pole, and a second position in which the cam surface permits movement of the sliding member with respect to the main pole.

3. The umbrella of claim 1, wherein the locking means for releasably securing the sliding member to the main pole comprises a plurality of teeth formed on the main pole and a cooperating pawl associated with the sliding member and selectively operative to engage a selected one of the teeth to prevent movement of the sliding member with respect to the main pole.

4. The umbrella of claim 1, wherein the locking means for releasably securing the sliding member to the main pole comprises a plurality of holes formed in the main pole and a pin associated with the sliding member and operative to engage a selected one of the holes.

5. The umbrella of claim 1, wherein the sliding member has a handle associated therewith.

6. The umbrella of claim 1, wherein the line extends along at least substantially the entire length of the arm.

7. The umbrella of claim 1, further comprising a crank handle operatively associated with the winder hub, whereby rotating the crank handle causes the winder hub to rotate.

* * * * *